US006116660A

United States Patent [19]

Langkamp, Jr. et al.

[11] Patent Number: 6,116,660

[45] Date of Patent: Sep. 12, 2000

[54] APPARATUS FOR SEALING LATCHING DEVICES

[75] Inventors: Richard B. Langkamp, Jr., Hemlock; D. Dale Turner, Honeoye Falls, both of N.Y.

[73] Assignee: Southco, Inc.

[21] Appl. No.: 09/165,657

[22] Filed: Oct. 3, 1998

Related U.S. Application Data

[63] Continuation-in-part of application No. 08/939,632, Sep. 29, 1997, abandoned.

[51] Int. Cl.[7] ..... E05C 5/00

[52] U.S. Cl. ..... 292/65; 292/203

[58] Field of Search ..... 292/58, 63, 65, 292/66, 71, 240, 256.5, 256.75, 257, 203, DIG. 53, 165, 169, 170, 175, DIG. 31, DIG. 37; 70/375, 404, 490, 491, DIG. 20, 125–127, 360

[56] References Cited

U.S. PATENT DOCUMENTS

| | | | |
|---|---|---|---|
| 2,991,106 | 7/1961 | Claud-Mantle . | |
| 3,971,242 | 7/1976 | Mikos . | |
| 4,022,039 | 5/1977 | Mikos . | |
| 4,556,244 | 12/1985 | Bisbing . | |
| 4,579,244 | 4/1986 | Fukuta . | |
| 4,583,775 | 4/1986 | Bisbing . | |
| 4,878,367 | 11/1989 | Bisbing . | |
| 5,076,080 | 12/1991 | Fuss . | |
| 5,092,633 | 3/1992 | Burkit | 285/109 |
| 5,165,738 | 11/1992 | McCormack . | |
| 5,368,347 | 11/1994 | Holtman | 292/257 |
| 5,409,272 | 4/1995 | McCormack | 292/66 |
| 5,494,420 | 2/1996 | Mawhirt | 417/500 |
| 5,590,921 | 1/1997 | Holtman | 292/257 |
| 5,638,106 | 6/1997 | Nierescher | 347/197 |
| 5,682,290 | 10/1997 | Markow | 361/683 |
| 5,732,844 | 3/1998 | Zorini . | |
| 5,791,171 | 8/1998 | Kelley | 70/58 |

OTHER PUBLICATIONS

Southco Latches and Access Hardware, Handbook 43, 1993, Section E, pp. E1–E13, (08/939,632).

*Primary Examiner*—B. Dayoan
*Assistant Examiner*—Gary Estremsky
*Attorney, Agent, or Firm*—Paul & Paul

[57] ABSTRACT

A latch has a housing for mounting in a door, panel or the like and a moveable pawl which engages a frame, panel or the like in a fastened position. The latch is provided with a substantially resilient member in the form of a seal, which is adapted to be compressed when the pawl is in the fastened position for inhibiting the passage of matter.

18 Claims, 5 Drawing Sheets

APPARATUS FOR SEALING LATCHING DEVICES

CROSS-REFERENCE TO RELATED APPLICATIONS

This application is a continuation-in-part of U.S. patent application Ser. No. 08/939,632 filed Sep. 29, 1997 now abandoned.

BACKGROUND OF THE INVENTION

1. Field of the Invention

The present invention relates generally to latching devices and more particularly to latching devices for securing a first member such as a door, panel or the like in a closed position relative to a second member such as a corresponding door, panel or frame.

2. Brief Description of the Prior Art

Various types of latching devices for use in securing a first member such as a door, panel or the like in a closed position relative to a corresponding second member such as a door, panel or frame are known.

Some types are adapted to be mounted within a first member and incorporate a pawl or similar member that is actuated to engage a second member for latching, such as are disclosed in U.S. Pat. Nos. 4,878,367, 4,763,935, 4,556,244 and 4,583,775, which are each assigned to Southco, Inc., the assignee of the present application. In each of these forgoing patents, there is seen a need to provide improved sealing of the latching devices in order to inhibit the penetration of matter, such as moisture and dust, which can affect operation of either the latching devices and/or the contents behind the first member.

The present invention has been developed in view of the foregoing and to overcome the deficiencies of the prior art.

SUMMARY OF THE INVENTION

An object of the present invention is to provide a latch having improved sealing and of the type mountable within an aperture of a first member, such as a door, panel or the like, and which engages a second member for latching, such as a door, panel or the like.

Another object of the present invention is to provide a latch of the type incorporating a pawl or similar member and which has improved sealing for inhibiting the passage of matter such as dust and moisture.

The foregoing objects are accomplished by a latch comprising a housing, fastening means and means for sealing the latch when the fastening means is in a latched position.

These and other objects of the present invention will become more readily apparent when taken into consideration with the following description and the attached drawings.

DETAILED DESCRIPTION OF THE PREFERRED EMBODIMENTS

The present invention is directed to an apparatus for sealing of latches, which have broad application and may be used in a wide variety of latches.

Illustrated in FIGS. 1–8 is one form of latch to which the apparatus for sealing of latches in accordance with the present invention may be applied. The particular latch shown in FIGS. 1–3 correspond to a latch shown, described and claimed in U.S. Pat. No. 4,583,775 referenced above entitled "Latch Assembly Having Pull-Up Action", which is incorporated by reference herein.

Figure 1:
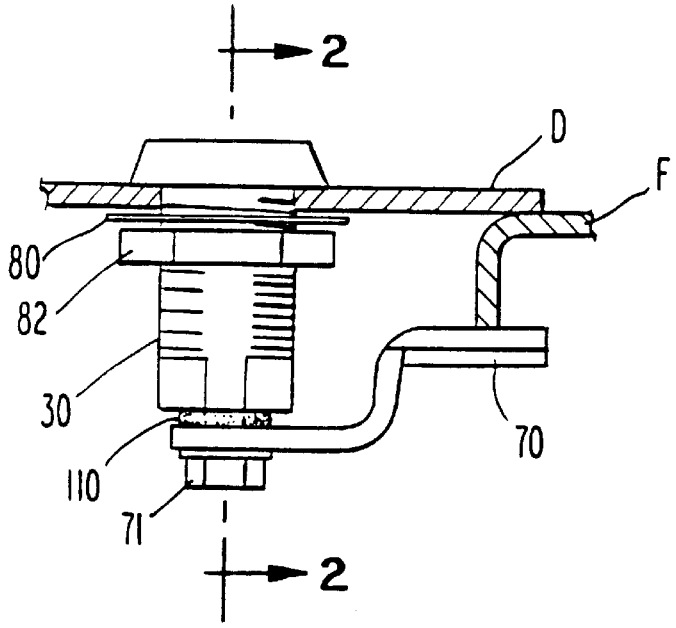
FIG. 1 is a front elevational view of a latch in accordance with an embodiment of the present invention.
Figure 2:
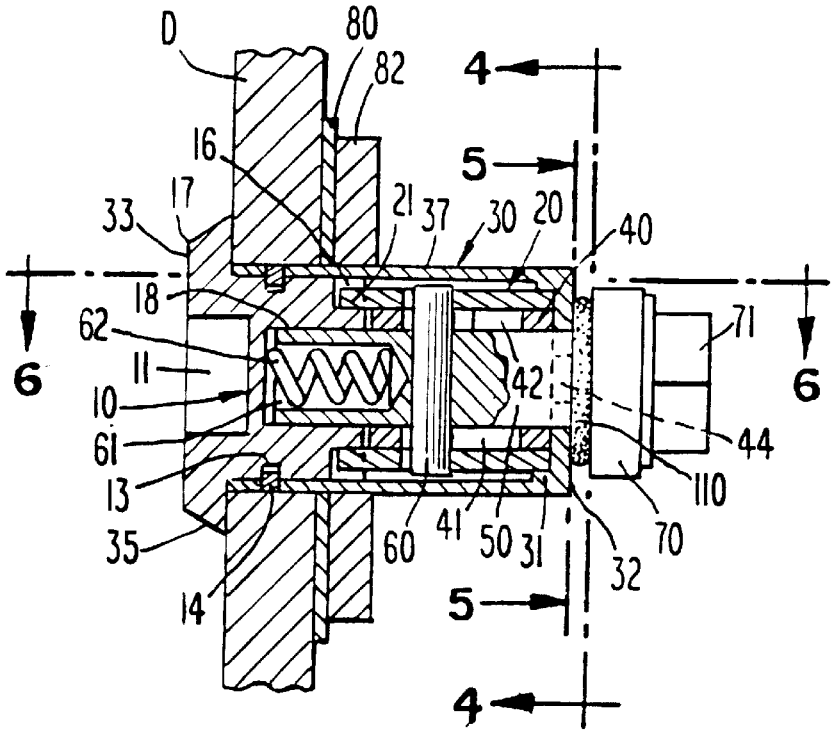
FIG. 2 is an elevational view, slightly enlarged, in section, looking along the line 2—2 of FIG. 1
Figure 3:
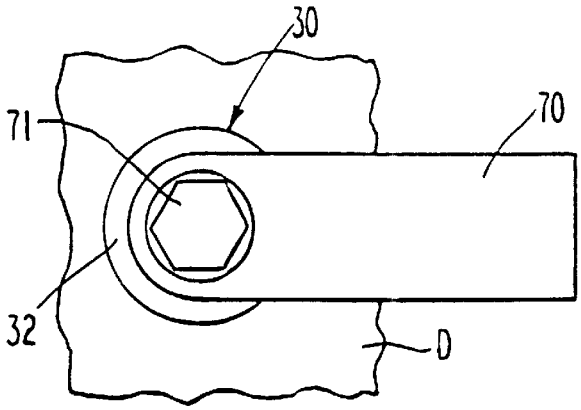
FIG. 3 is a bottom plan view of the latch of FIG. 1.
Figure 4:
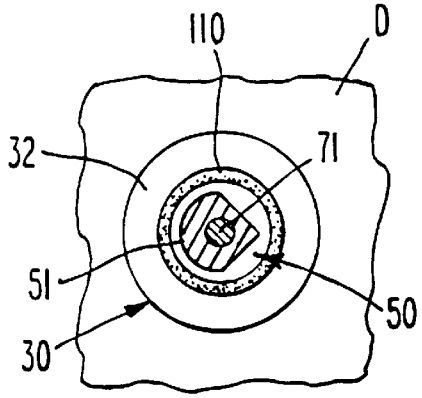
FIG. 4 is a bottom plan view, in section, looking along the line 4—4 of FIG. 2.

In FIGS. 1 and 2, closure element D such as a door, panel or the like, has mounted thereon a latch mechanism having a housing 30, a shaft 50 having an end 54 and fastening means comprising in this embodiment a latching pawl 70 which is mounted on the end of the shaft 50 as by a bolt 71.

Figure 5:
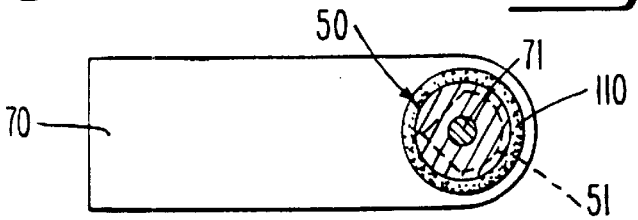
FIG. 5 is a top plan view, in section, looking along the line 5—5 of FIG. 2.

In this embodiment, attachment means may be provided between the shaft 50 and latching pawl 70 for mounting of the latching pawl 70 in one orientation. For this purpose, the shaft 50 is provided with at least one section 51 proximate its lower end preferably noncircular in cross-section, which in this embodiment is defined by two planar surfaces and one radiused surface generally in the shape of a triangular as is best seen in FIG. 5. The latching pawl 70 in turn is provided with an aperture through its upper and lower surfaces which corresponds in configuration to the cross-sectional shape of the section 51 of the shaft 50. In this manner, mounting of the latching pawl 70 on the shaft 50 is regulated by alignment of the section 51 with the aperture of the pawl 70. The shaft 50 is also provided with a threaded cavity within its lower end for receiving the bolt 71 so as to retain the position of the latching pawl 70 on the shaft 50.

The latching pawl 70 is movable rotationally by shaft 50 and is also moveable by shaft 50 axially in the longitudinal direction of the shaft. To latch the closure element D to the frame F, the latching pawl 70 is first rotated to a position such that it is in line with the frame member F. The latch assembly is then moved longitudinally so that it engages the edge of the frame F. The shaft 50 is moved rotationally and also longitudinally by means of a rotatable actuator 10. In the present embodiment, the rotatable actuator 10 comprises a drive plug shown to have a square shaped recess 11 for receiving a correspondingly shaped driver of a drive tool. The recess 11 and corresponding driver could, of course, have other shapes; for example, hexagonal or octagonal. Further, the positions of the recess 11 and driver can be switched or the recess 11 can be provided in other forms, such as a cap or handle.

The plug 10 is generally cylindrical and has a cylindrical bore 18 which receives the outward end of the shaft 50. The plug 10 is rotatable within the housing 30 and is prevented from movement in the axial direction of shaft 50 by a retaining ring 14 which is received within grooves 13 located in registered positions in plug 10 and housing 30. The inward end of the plug 10 is provided with a pair of notches 16 which receive ears 21 which project axially outwardly from a sleeve-like cam 20. Thus, when plug 10 is rotated, as by a suitable tool, the sleeve-like cam 20 is also rotated. The plug 10 and cam 20 may also be provided as one piece.

The sleeve-like cam 20 is provided with at least one and, in the present embodiment, a pair of cam slots 25 spaced 180° apart circumferencially. Each of the slots 25 run in a direction which has both circumferencial and axial components.

Positioned coaxially between shaft 50 and the sleeve-like cam 20 is a fixed motion control sleeve 40 having a pair of axial slots 41 and a pair of lateral or circumferencial slots 42. In the present embodiment, one slot of each pair is spaced 180° from the other. The inward end of each axial slot connects with one end of one of the circumferencial slots. The motion control sleeve 40 is prevented from moving rotationally relative to housing 30 by a pair of ears 44 which project axially inwardly into slots in the inward end 32 of the housing 30. The fixed motion control sleeve 40 may also be provided integral with the housing 30 being formed directly within or extending from an inner surface of the housing 30. The pair of slots 41 and 42 in the motion-control sleeve 40 function respectively as axial motion-control slots and as lateral motion-control slots.

The housing 30 in the present embodiment is a generally elongate component defined by an upper end, a lower end, an opening extending longitudinally through the housing 30 and an outer surface. The lower end 32 of housing 30 is closed except for a central opening through which shaft 50 passes. In the present embodiment, the inward ends of the motion-control sleeve 40 and sleeve-cam 20 abut against the inward end 32 of the housing 30. The plug 10 is positioned within the opening through the housing 30 adjacent to the upper end 33 of the housing 30. The outer surface of the housing 30 includes a flanged first portion 35 adjacent to the upper end 33. The outer surface of the housing 30 as best shown in the bottom plan view of FIG. 3 also includes a second portion 37 which is substantially circular in cross-section. However, it should be understood that the cross-sectional shape of the second portion 37 of housing 30 can be of any desired configuration. In addition, in the present embodiment as illustrated in FIG. 1, the second portion 37 of housing 30 is further provided with a section having a series of threads provided within the outer surface. Further, in the present embodiment, the plug 10 and first portion 35 of housing 30 may be provided with corresponding notches which operate as an indicator of the position of the pawl 70.

As best illustrated in FIG. 2, shaft 50 is an elongated shaft, the outer or head end of which is received within the cavity of bore 18 in the plug 10. Shaft 50 projects inwardly through the hole and the inward end 32 of housing 30 and beyond, with the shaft so supported that the center axis of the shaft coincides with the center axis of motion-control sleeve 40 and cam 20.

The relative positions of the motion-control sleeve 40 and cam 20 could be reversed. That is, motion-control sleeve 40 could be readily outside of cam 20 rather than within as shown.

Mounted on the shaft 50 is the cross-pin 60 which projects laterally in both directions from the shaft and functions as both a cam follower and as a motion-control pin.

Figure 6:
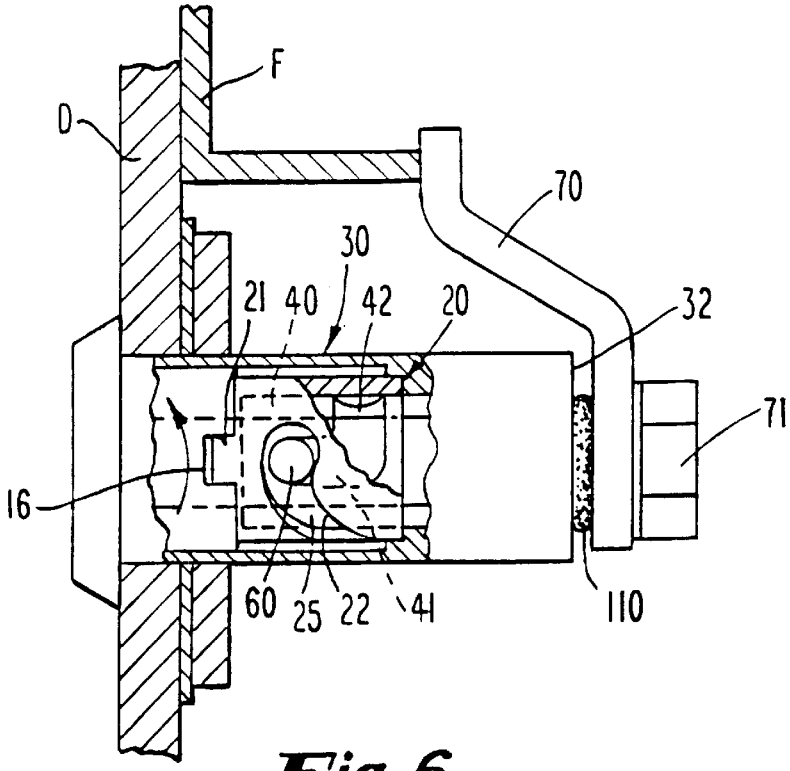
FIG. 6 is a view, partly in section, showing the latch mounted on the door of the cabinet and in fully latched position.

The outward end of shaft 50 is provided with a center bore 61 in which a coil compression spring 62 is placed. The outward end of compression spring 62 bears against the plug 10. Thus, compression spring 62 biases shaft 50 inwardly toward the unlatching position. This biasing force maintains the ends of cross pins 60 in close contact with the inner wall 22 of cam slot 25 as best illustrated in FIG. 6. The biasing spring 62 is desirable but not essential since even without the spring, the ends of the cross-pins 60 would follow the cam slots 25. However, the cam slot 25 has a width which is somewhat greater than the diameter of the cross-pin 60 and accordingly the biasing spring is useful in maintaining the cross pin against the inward wall of the slots. Cross-pin 60 controls whether, in response to rotation of the plug 10, shaft 50 and pawl 70 will move only axially or only angularly. This is determined by whether the opposite ends of pin 60 are within the axial motion-control slots 41 or in the lateral motion control slots 42. In another embodiment, the plug 10, cam 20 and shaft 50 can be provided as a single piece.

The housing 30 is mounted on the closure member D by retaining means which, in the present embodiment, is comprised of a mounting nut 82 engaging the threads on the outer surface of housing 30.

In the present embodiment, the housing 30 is mounted by first inserting the latch into the aperture through closure member D. Specifically, the latch is inserted in an inward direction with its lower end 32 first being inserted into the aperture in the closure D, which is most easily accomplished when the pawl 70 is not mounted on the shaft 50, so that the shaft 50 can be inserted first through the aperture in the closure member D, however, such is not required.

The housing 30 is then secured within the aperture of the closure member D in a position shown in FIG. 1 by the mounting nut 82 and, if desired, washer 80.

In accordance with a presently preferred embodiment, means are provided for sealing of the latch in operation, which preferably will inhibit the passage of matter, such as moisture or dirt, from entering into and or through the latch, for example, matter entering into the latch can damage the latch components or impede its operation. Moreover, matter entering through the latch can damage the contents behind closure member D. For this purpose, in the present embodiment, the sealing means comprises a substantially resilient member 110, such as an O-ring comprised on an elastomeric material. The resilient member 110 preferably is provided with an opening therethrough deforming on inner surface 115 which is circular in the present embodiment, for being received onto the shaft 50. The resilent member 110 is further comprised of an outer surface 117 defining a perimeter spaced from the inner surface 115 and a connecting surface 119 extending between the outer surface 117 and the inner surface 115. In the present embodiment, the resilient member 10 is positioned between the lower end 32 of the housing 30 and the latching pawl 70. Preferably, the resilient member 10 is in a compressed state when in a latched position through engagement on its opposite sides by the upper surface of the latching pawl 70 and the lower end 32 of the housing 30. As will be described in more detail herein, the latching pawl 70 is adapted to be moved axially in a direction of said lower end 32 of the housing 30 in order to compress the resilient member 110 between the lower end 32 of housing 30 and upper surface of latching pawl 70 when the latching pawl 70 is moved to the latched position Further, when in an unlatched position, preferably the resilient member 110 is in a noncompressed state, which occurs due to the latching pawl 70 moving axially away from the lower end 32 of the housing 30. When in the noncompressed state, the resilient member 110 is able to float along the shaft 50 between the latching pawl 70 and lower end 32 of the housing 30. In the present embodiment, the resilient member 110 is shown being positioned adjacent the upper surface of the latching pawl 70 and at spaced separation from the lower end 32 of the housing 30, although as should be understood, the resilient member 10 can also be positioned at other locations along shaft 50.

In the present embodiment, the components of the latch other than the resilient member 110 are preferably comprised of metal and metal alloy materials, however, other suitable materials can also be used where desired. In addition, in the present embodiment, closure member D is comprised of wood, however, the closure D can also be comprised of other materials, such as metal, and of varying thicknesses.

The resilient member 110 can also be comprised partially, substantially or entirely of PORON™ material closed-cell polyurethane foam. Preferably, the resilient member 110 in this embodiment is comprised entirely of PORON™ material providing a PORON™ gasket. Similar to that described earlier, the resilient member 110 when comprising a PORON™ gasket preferably includes an opening therethrough and with the opening appropriately sized so that a tight fit is provided when assembled to the shaft 50. The use of PORON™ material has an advantage that it provides a low durometer foam gasket. For example, the PORON™ gasket when compressed expands both radially inward and radially outward which results with a tight seal between the shaft 50 and the housing 30 and between the pawl 70 and housing 30 as well. The radial expansion of the PORON™ gasket eliminates the need to contain the gasket on all sides to provide a sufficiently tight seal, such as a NEMA rating of 4 (water tight seal), which has been found to be required when using an o-ring or similar gasket material. For example, applicant has found that an o-ring as the resilient member 110 will expand radially outward when compressed, which has the affect that after prolong periods of operation the o-ring would squeeze out and either not provide a sufficiently tight seal or not seal at all.

Figure 9:
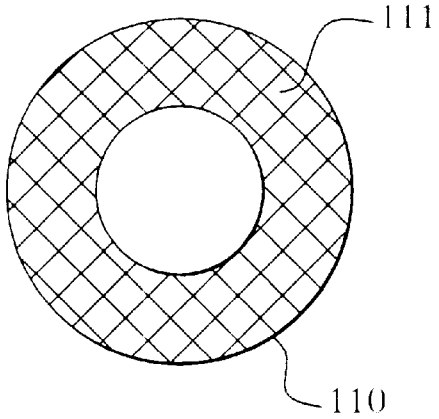
FIG. 9 is an isolated top plan view of another embodiment of a resilient member in accordance with the latch of FIG. 1.
Figure 10:
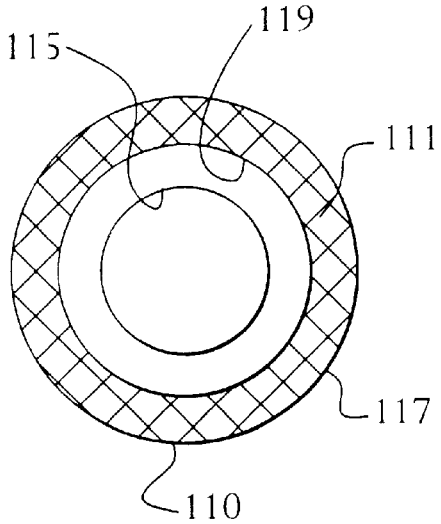
FIG. 10 is an isolated top plan view of still another embodiment of a resilient member in accordance with the latch of FIG. 1.
Figure 11:
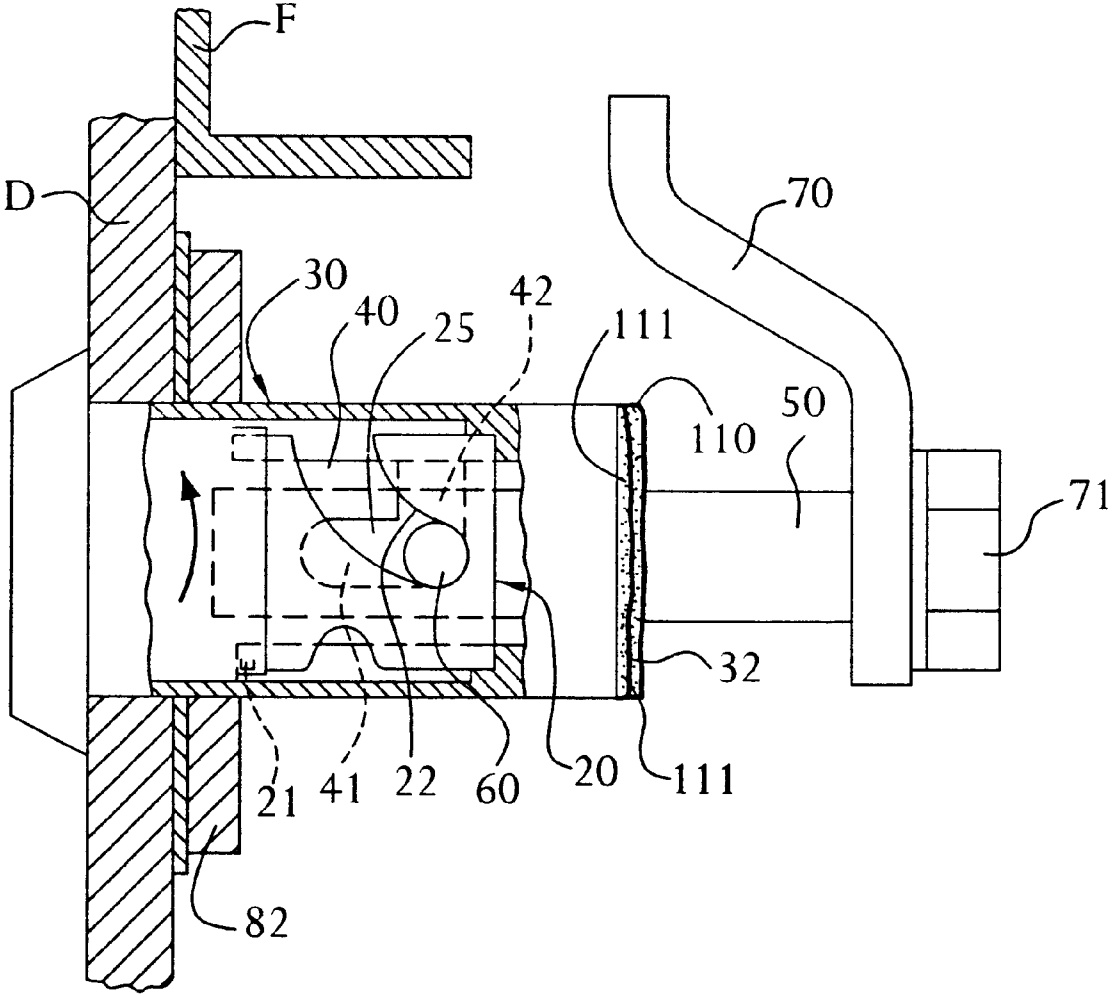
FIG. 11 is a view similar to that of FIG. 6 but showing the resilent member illustrated in FIG. 10 attached to a lower surface of the housing.

In addition, in still other embodiments, the resilient member 110 can be secured, such as by any conventional adhesive, to either the lower end 32 of the housing 30 or to the upper portion of pawl 70. In a preferred embodiment, the adhesive 111 is a pressure sensitive adhesive in the nature of double sided tape and is applied substantially across the entire surface of one of the two surfaces of the resilient member 110 that is transverse the shaft 50, as is illustrated in FIG. 9. In a more preferred embodiment, the adhesive 111 is again a pressure sensitive adhesive and applied only on the outer perimeter of the surface of one of the two surfaces of the resilient member 110 that is transverse the shaft 50, as is illustrated in FIG. 10. An advantage in the use of any adhesive, including a pressure sensitive adhesive, that is applied only toward the outer perimeter is that there is no adhesive adjacent the opening through the resilient member 110. For example, applicant has observed that the use of an adhesive applied substantially across the entire surface can at times result with the adhesive sticking to the shaft in operation and create a tear in the resilient member 110. In a preferred embodiment, the pressure sensitive adhesive is applied to the resilient member 110 comprising a PORON™ gasket and the adhesive is secured to the lower end 32 of the housing 30, as illustrated in FIG. 11 although as should be understood any other type of adhesive or resilient member 110 can also be utilized where desired and the adhesive can be secured to other areas of the latch, such as to the upper end of pawl 70. In still other embodiments, the resilient member 110 can be secured by other means to a portion of the latch or formed integral with a portion of the latch.

The operation of the latch when in a mounted position will now be described.

As seen best in FIGS. 1 and 2, when plug 10 is rotated, as by a tool, the sleeve-like cam 20 will be driven rotationally due to the projection of cam ears 21 into the notches 16 in plug 10. When cam 20 is rotated, cross pin 60 is moved, but whether the movement is axial or lateral is dependent upon whether the ends of pin 60 are in the axial or lateral slots of the motion-control sleeve 40.

In FIG. 6 the latch is shown in the fully latched position in which the latch pawl 70 is in alignment with, and in engagement with, the cabinet frame F. When in the latched position, plug 10 is at its fully clockwise position, as viewed looking from the left in FIG. 6 and the two opposite ends of cross pin 60 project through the axial slots 41 in the motion-control sleeve 40 and into the closed outmost ends of cam slots 25.

To unlatch the closure member D from the cabinet frame F, plug 10 is turned in the counterclockwise direction in the direction of the arrow shown in FIG. 6. When this is done, plug 10 and cam 20 rotate as a unit. The cross pin 60 cannot move rotationally because its opposite ends are within the diametrically-opposed axial slots 41 of the fixed motion-control sleeve 40. As a result, when cam 20 is rotated counterclockwise, the force of the biasing spring 62 causes the opposite ends of pin 60 to follow the inward walls 22 of the opposed cam slots 25, and, as a result, pin 60, and hence also shaft 60 and latch pawl 70, move in the inward unlatched direction until the ends of the pin 60 reach the lateral slots 42.

Figure 7:
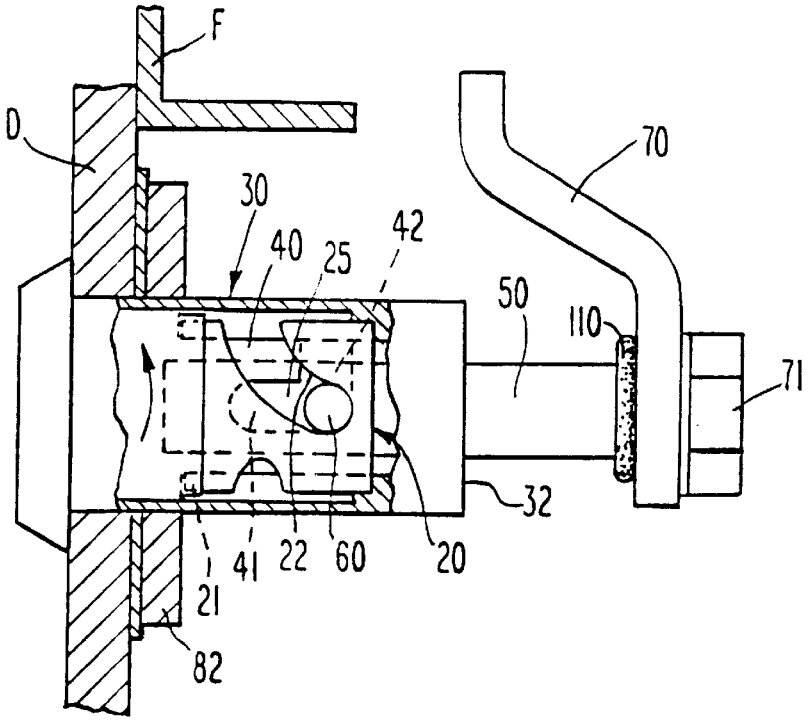
FIG. 7 is a view similar to that of FIG. 6 but showing the latch in partly unlatched position.
Figure 8:
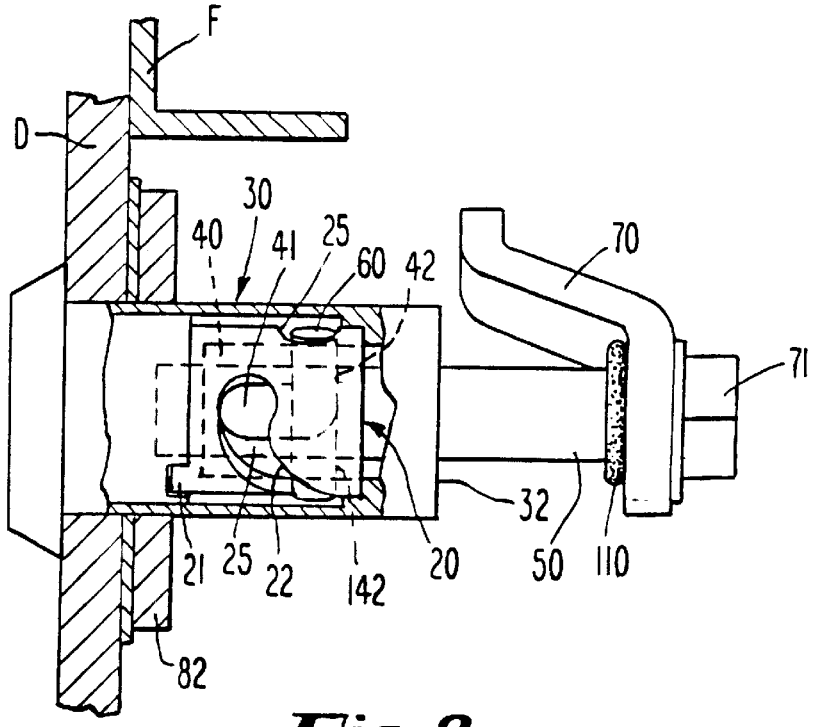
FIG. 8 is a view similar to that of FIGS. 6 and 7 but showing the latch in fully unlatched position.

After plug 10 and cam 20 have been rotated as a unit through 120° from the position shown in FIG. 6, cross pin 60 has moved axially inwardly to the position shown in FIG. 7, and is now aligned with the opposed lateral slots 42. Further rotation of plug 10 and cam 20 now causes rotational movement of cross pin 60, shaft 50 and pawl 70, as the opposed ends of pin 20 move into the opposed lateral slots 42. In this manner, pawl 70 is moved out of alignment with frame member F and, after 60 degrees of rotation, the door D is fully unlatched, as is illustrated in FIG. 8. Plug 10 is now 180° from the fully latched position shown in FIG. 6.

The latching action is simply the reverse of the unlatching action which has just been described. On latching, as plug 10 is turned clockwise, the opposite ends of cross pin 60 move laterally in the lateral slots 42 and shaft 50 rotates on its axis. Then the cross pin 60 translates axially outwardly. These sequential motions are caused by the walls 22 of the cam slots 25 which urge the ends of the cross pin 60 through the lateral motion-control slots 42 in the lateral or circumferencial direction until the ends of the cross pin abut against the edge of the axial motion-control slots 41. Thereafter, walls 22 of the cam slots 25 urge the ends of the cross pin 60 axially outwardly through axial slots 41. Thus, cam 20 and the motion-control slots 41 cause the angular and axial motions to take place in sequence, in response to turning the plug 10 in the latching direction in one continuous motion.

The new latch has been described as mounted on the movable door. This is the preferred location. However, a latch embodying the basic concept of the present invention could be mounted on the fixed cabinet rather than on the door. In such case, the shaft and latch pawl would be moved angularly to engage a keeper mounted on the inside of the door and then axially inwardly to pull the door to tightly closed position. This is the reverse of the axial motion used to pull the door tightly shut when the latch is mounted on the door.

In view of that set forth above, it will be understood that there are several advantages disclosed with respect to the present invention. One advantage is that a resilient member, such as an o-ring or similar member or PORON™ gasket, is disclosed which operates as a seal against dust, water, moisture, etc. from entering the latch through the opening in the lower end 32 of the housing by sealing against the housing and the pawl. Another advantage of the present invention is that it discloses a resilient member 110 that operates to provide a tight seal only when the resilent member 110 is compressed between the housing and pawl, which has the benefit to increase the overall life of the seal in contrast to an arrangement where the resilient member 110 would always be in a compressed state. In addition, the PORON™ gasket provides still improved operation over a seal of the o-ring type due to expansion radially in both an inward and outward direction when compressed. Still another advantage of the present invention is that the resilient member 110 acts not only as a seal from matter passing into the latch but also as a seal from matter passing out from the latch, such as grease or other lubricating material that is typically used inside the housing. In addition, still another advantage is that the resilient member 110 acts as a wiper over the shaft 50 as the latch is operated between its latched and unlatched positions, such as to remove any grease or other matter that may accumulate on the shaft, which improves both operation and the overall appearance of the latch. Still another advantage of the present invention is that an adhesive such as a pressure sensitive adhesive can be utilized to fix the resilient member 110 at a given position on the latch, such as adjacent to the lower end of the housing or to the pawl.

It will be recognized by those skilled in the art that changes may be made by the above-described embodiments of the invention without departing from the broad inventive concept thereof. For example, an additional member or members maybe positioned adjacent and/or against either or both of the lower end of the housing and the upper surface of the pawl, with the resilient member then being adapted to engage the additional member or members; for example, the pawl can be mounted on a threaded shaft by mounting nuts against both the upper and lower surfaces of the pawl, so that the resilient member would engage the mounting nut rather than the pawl. It is understood, therefore, that this invention is not limited to the particular embodiments disclosed, but it is intended to cover all modifications which are within the scope and spirit of the invention as defined by the appended claims.

What is claimed is:

1. A latch comprising:

a housing generally elongate along a longitudinal axis defining an upper end, an outer surface, a lower end, and an opening at least within said lower end extending in a direction of said longitudinal axis of said housing in a direction of said upper end;

a shaft substantially elongate and disposed within said opening of said housing, said shaft having a terminating end positioned outside of said opening of said housing;

actuating means operatively associated with said shaft for rotation along an axis coincident with said longitudinal axis of said housing to move said shaft at least in a substantially axial direction relative to said longitudinal axis of said housing, said actuating means comprising means for translating rotation of said actuating means to substantial axial translation of said shaft;

fastening means including a pawl attached with said terminating end of said shaft for movement at least in an axial direction between latched and unlatched positions corresponding with movement of said shaft, wherein said fastening means is at spaced separation from said lower end of said housing and said fastening means is closer to the lower end of the housing in the latched position than the unlatched position; and means for sealing said opening of said housing comprising a sealing member substantially of an elastomeric material and having an opening therethrough positioned on said terminating end of said shaft between said lower end of said housing and said fastening means, and with said sealing member being of a defined height and with said defined height being greater than said spaced separation between said fastening means and said lower end of said housing in said latched position, and said defined height of said sealing member being smaller than said spaced separation between said fastening means and said lower end of said housing in said unlatched position, wherein said sealing member is compressed by contact with the lower end of the housing and the fastening means when the pawl is in its latched position, said sealing member being uncompressed when the pawl is in its unlatched position.

2. A latch according to claim 1, wherein said sealing member is secured to said lower end of said housing.

3. A latch according to claim 2, further comprising attachment means between said pawl and said shaft for mounting of said pawl in one orientation.

4. A latch according to claim 2, wherein said sealing member further comprises an inner surface defined by said opening and through which said shaft is disposed, an outer surface defining a perimeter spaced from said inner surface, and a connecting surface extending between said inner surface and said outer surface, said connecting surface having an adhesive thereon securing said sealing member to said housing and with said adhesive being positioned on said connecting surface at spaced separation from said inner surface of said sealing member.

5. A latch according to claim 4, wherein said sealing member is comprised substantially of closed-cell polyurethane foam, wherein when said sealing member is under compression, said sealing member is expanded both in a first direction generally toward said shaft and in a second direction substantially opposite said first direction generally away from said shaft.

6. A latch according to claim 4, wherein said adhesive comprises a pressure sensitive adhesive.

7. A latch according to claim 1, wherein said actuating means further comprises means between said housing and said shaft for imparting rotational movement to said shaft on rotation of said actuating means.

8. A latch according to claim 7, further comprising biasing means for biasing said shaft in one direction and said actuating means comprises a cam, a first boss on said shaft engaging said cam for regulating axial movement of said shaft, and a wall engaged by said boss or a second boss for limiting rotational movement of said shaft.

9. A latch comprising:

a housing generally elongate along a longitudinal axis defining an upper end, a lower end, and an opening at least within said lower end;

a shaft disposed within said opening of said housing;

actuating means for moving said shaft at least in an axial direction relative to said longitudinal axis of said housing;

fastening means attached with said shaft for movement at least in an axial direction between latched and unlatched positions; and means for sealing said opening of said housing comprising a sealing member positioned on said shaft and attached by an adhesive to said lower end of said housing, wherein said sealing member comprises an opening therethrough defining an inner surface through which said shaft is disposed, an outer surface defining a perimeter spaced from said inner surface, and a connecting surface extending between said inner surface and said outer surface, wherein said connecting surface of said sealing member includes said adhesive thereon and with said adhesive being positioned on said connecting surface at spaced separation from said inner surface of said sealing member, wherein said sealing member is in a compressed state when said fastening means is in said latched position and in a uncompressed state when said fastening means is in said unlatched position.

10. A latch according to claim 8, wherein said adhesive comprises a pressure sensitive adhesive.

11. A latch according to claim 9, wherein said sealing member is comprised substantially of closed cell, polyurethane foam material.

12. A latch according to claim 8, further comprising attachment means between said pawl and said shaft for mounting of said pawl in one orientation.

13. A latch according to claim 9, wherein said latch further comprises means between said housing and said shaft for imparting either rotational or axial movement to said shaft.

14. A latch according to claim 13 further comprising biasing means for biasing said shaft in one direction.

15. A latch comprising:

a housing generally elongate along a longitudinal axis defining an upper end, a lower end, and an opening at least within said lower end;

a shaft disposed within said opening of said housing;

actuating means for moving said shaft at least in an axial direction relative to said longitudinal axis of said housing;

fastening means attached with said shaft for movement at least in an axial direction between latched and unlatched positions; and means for sealing said opening of said housing comprising a sealing member positioned on said shaft and attached by an adhesive to one of said lower end of said housing or said fastening means, wherein said sealing member comprises an opening therethrough defining an inner surface through which said shaft is disposed, an outer surface defining a perimeter spaced from said inner surface, and a connecting surface extending between said inner surface and said outer surface, said connecting surface having said adhesive thereon and with said adhesive being positioned on said connecting surface at spaced separation from said inner surface of said sealing member, wherein said sealing means is in a compressed state when said fastening means is in said latched position and in a uncompressed state when said fastening means is in said unlatched position.

16. A latch according to claim 15, wherein said sealing member is attached by said adhesive to said lower end of said housing.

17. A latch according to claim 16, wherein said adhesive comprises a pressure sensitive adhesive for attaching said sealing member to said lower end of said housing.

18. A latch according to claim 17, wherein said sealing member is comprised substantially of closed cell, polyurethane foam material.

* * * * *

UNITED STATES PATENT AND TRADEMARK OFFICE

CERTIFICATE OF CORRECTION

PATENT NO. : 6,116,660

DATED : September 12, 2000

INVENTOR(S) : Richard B. Langkamp, Jr., D. Dale Turner

It is certified that error appears in the above-identified patent and that said Letters Patent are hereby corrected as shown below:

In column 4, line 57, delete "10" replace with --110--.
In column 4, line 59, delete "10" replace with --110--.
In column 5, line 11, delete "10" replace with --110--.
In column 9, line 26, delete "8" replace with --9--.
In column 9, line 28, delete "9" replace with --10--.
In column 9, line 31, delete "8" replace with --9--.

Signed and Sealed this

First Day of May, 2001

*Attest:*

Nicholas P. Godici

NICHOLAS P. GODICI

*Attesting Officer*

*Acting Director of the United States Patent and Trademark Office*